US006694860B2

(12) United States Patent
Yoshino

(10) Patent No.: US 6,694,860 B2
(45) Date of Patent: Feb. 24, 2004

(54) HYDRAULIC CONTROL SYSTEM WITH REGENERATION

(75) Inventor: Kazunori Yoshino, Kobe (JP)

(73) Assignees: Caterpillar Inc, Peoria, IL (US); Shin Caterpillar Mitsubishi Ltd (JP)

( * ) Notice: Subject to any disclaimer, the term of this patent is extended or adjusted under 35 U.S.C. 154(b) by 64 days.

(21) Appl. No.: 10/006,895

(22) Filed: Dec. 10, 2001

(65) Prior Publication Data

US 2003/0106420 A1 Jun. 12, 2003

(51) Int. Cl.[7] ..... F15B 11/08
(52) U.S. Cl. ..... 91/454; 91/436; 60/468
(58) Field of Search ..... 91/436, 437, 454; 60/468

(56) References Cited

U.S. PATENT DOCUMENTS

| | | | | |
|---|---|---|---|---|
| 3,974,742 A | | 8/1976 | Johnson | |
| 4,250,794 A | * | 2/1981 | Haak et al. | 91/454 |
| 4,416,187 A | | 11/1983 | Nyström Per H. G. | |
| 4,418,794 A | | 12/1983 | Manco | |
| 4,437,385 A | | 3/1984 | Kramer et al. | |
| 4,579,042 A | | 4/1986 | Neff | |
| 5,115,720 A | | 5/1992 | Babson et al. | |
| 5,136,929 A | | 8/1992 | Kervagoret | |
| 5,138,838 A | | 8/1992 | Crosser | |
| 5,168,705 A | | 12/1992 | Hirata et al. | |
| 5,214,997 A | | 6/1993 | Lebret | |
| 5,226,348 A | | 7/1993 | Dezelan et al. | |
| 5,351,601 A | | 10/1994 | Zeuner et al. | |
| 5,370,038 A | | 12/1994 | Poppe et al. | |
| 5,469,703 A | | 11/1995 | Ericsson et al. | |
| 5,575,150 A | | 11/1996 | Vieten et al. | |
| 5,682,955 A | | 11/1997 | Groth et al. | |
| 5,947,140 A | | 9/1999 | Aardema et al. | |
| 5,960,695 A | | 10/1999 | Aardema et al. | |
| 6,161,467 A | | 12/2000 | A'Hearn et al. | |
| 6,467,264 B1 | * | 10/2002 | Stephenson et al. | 91/454 |

* cited by examiner

*Primary Examiner*—Edward K. Look
*Assistant Examiner*—Michael Leslie
(74) *Attorney, Agent, or Firm*—Finnegan, Henderson, Farabow, Garrett & Dunner

(57) ABSTRACT

A fluid control system includes a pump, a tank, and an actuating cylinder having a rod end chamber and a head end chamber. The fluid control system also includes an independent metering valve arrangement and a pressure sensor configured to sense a pressure of fluid at the head end chamber. A controller communicates with the valve assembly and the pressure sensor. The controller selectively actuates at least one valve of the independent metering valve arrangement based on the sensed pressure at the head end chamber and a mode of operation of the control system.

21 Claims, 2 Drawing Sheets

HYDRAULIC CONTROL SYSTEM WITH REGENERATION

TECHNICAL FIELD

The invention relates generally to a fluid control system and, more particularly, to a hydraulic control system having an independent metering valve arrangement with regeneration capability.

BACKGROUND

Conventional fluid control systems may include a regeneration capability, which may include the ability to re-direct some of the energized fluid exhausted from a contracting chamber of a double acting hydraulic cylinder to a corresponding expanding chamber. This fluid redirection enhances operational speed over that provided by pump flow only.

One common type of fluid control system with regeneration includes a separate regeneration valve disposed between a main directional control valve and the hydraulic cylinder to provide a quick drop feature for actuators driven in one direction by gravity loads. A problem associated with such a system is that the operator has little or no control over the amount of regenerated fluid recirculated from the contracting chamber to the expanding chamber. Moreover, regeneration takes place only under certain conditions because such regeneration valves are frequently triggered automatically based on system conditions. Additionally, providing a separate regeneration valve is a generally expensive and complex alternative.

In the environment of an independent metering valve arrangement, U.S. Pat. No. 5,960,695 discloses a hydraulic control system comprising an independent metering valve arrangement having regeneration capability during extension of a load based on pressure differences measured across metering valves.

A system that simply and inexpensively provides regeneration capability during retraction of a load is desired. The present invention is directed to solving one or more of the problems set forth above.

SUMMARY OF THE INVENTION

According to one aspect of the invention, a fluid control system includes a pump, a tank, an actuating cylinder having a rod end chamber and a head end chamber, and a valve assembly. The valve assembly may include a first valve configured to control fluid communication between the rod end chamber and the tank, a second valve configured to control fluid communication between the rod end chamber and the pump, a third valve configured to control fluid communication between the head end chamber and the pump, a fourth valve configured to control fluid communication between the head end chamber and the tank, and a load hold check valve configured to control fluid communication between the pump and the actuating cylinder. The fluid control system also includes a pressure sensor configured to sense a pressure of fluid at the head end chamber and a controller in communication with the valve assembly and the pressure sensor. The controller may be configured to selectively actuate the valves based on the sensed pressure at the head end chamber and a mode of operation of the control system.

According to another aspect of the invention, in a hydraulic system including a pump, a tank, an actuating cylinder having a rod end chamber and a head end chamber, and a valve assembly, a method for controlling the hydraulic system includes sensing a pressure of fluid at the head end chamber and selectively actuating the valve assembly based on the sensed pressure and a mode of operation of the hydraulic system.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate an embodiment of the invention and together with the description, serve to explain the principles of the invention. In the drawings.

DETAILED DESCRIPTION

Reference will now be made in detail to drawings and wherever possible, the same reference numbers will be used throughout the drawings to refer to the same or like parts.

Figure 1:
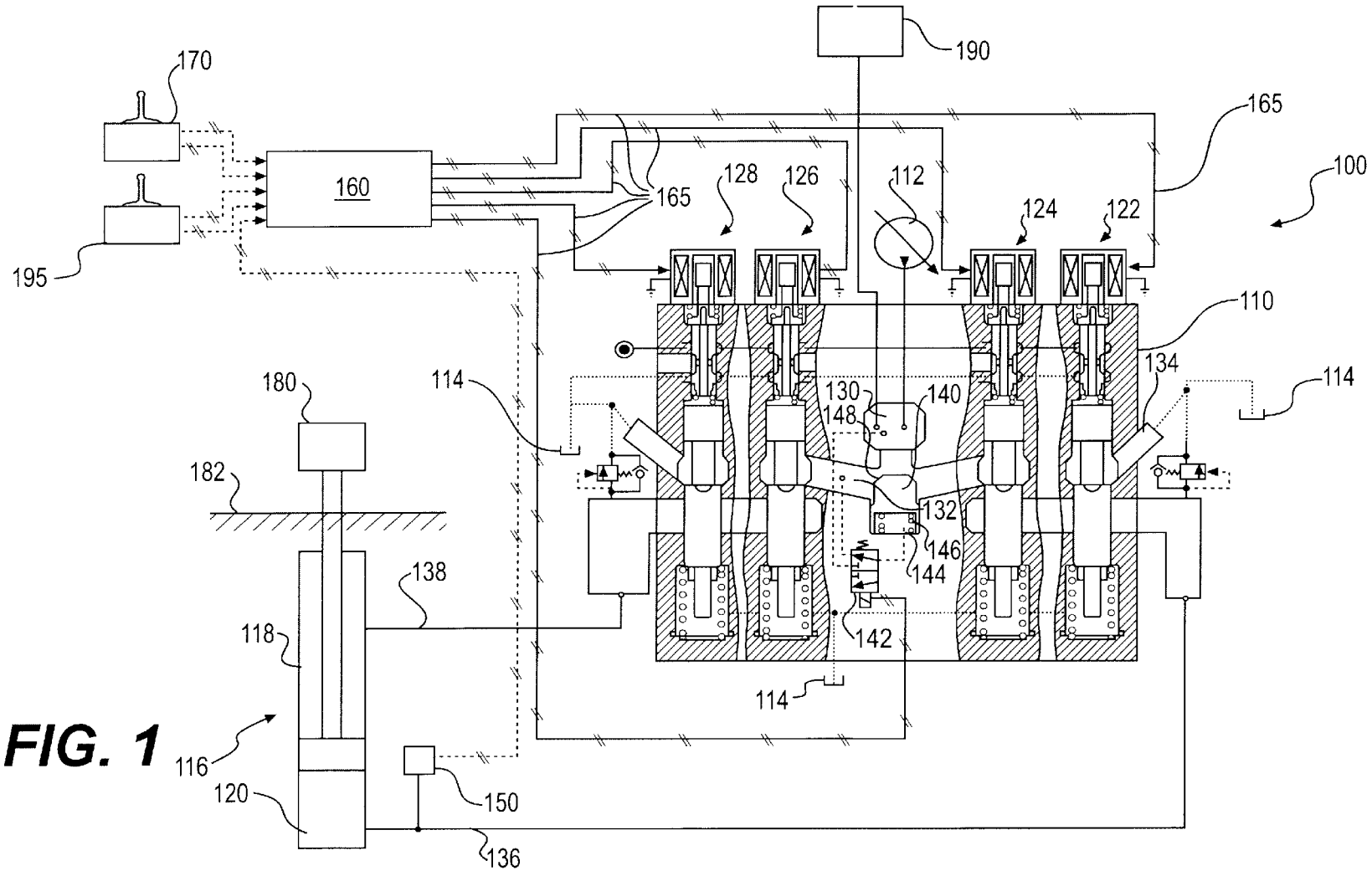
FIG. 1 is a combination schematic and diagrammatic illustration of a hydraulic circuit in accordance with one embodiment of the present invention.

In accordance with the present invention, a fluid control system is provided. Referring to FIG. 1, a fluid control system, for example, hydraulic circuit 100, includes a valve assembly, for example, an independent metering valve arrangement 110, a pump 112, a tank 114, and an actuating cylinder, for example, a hydraulic cylinder 116 having a rod end chamber 118 and a head end chamber 120. The pump 112 may comprise, for example, a high pressure pump. The independent metering valve arrangement 110 includes a plurality of independently-operated, electronically-controlled metering valves 122, 124, 126, 128. The metering valves 122, 124, 126, 128 control fluid flow between the pump 112, the tank 114, and the hydraulic cylinder 116. The metering valves may be spool valves, poppet valves, or any other conventional type of metering valve that would be appropriate. The metering valves are referred to individually as a cylinder-to-tank head end (CTHE) metering valve 122, a pump-to-cylinder head end (PCHE) metering valve 124, a pump-to-cylinder rod end (PCRE) metering valve 126, and a cylinder-to-tank rod end (CTRE) metering valve 128.

The independent metering valve arrangement 110 also includes a pump inlet port 130, a supply port 132, a tank port 134, a head end cylinder port 136, and a rod end cylinder port 138. In addition, the independent metering valve arrangement 110 includes a load-hold check valve 140 equipped with a solenoid valve 142. A spring 146 urges the load-hold check valve 140 to a closed position. The solenoid valve 142 may be controlled such that a spring chamber 144 of the load-hold check valve 142 can be selectively placed in communication with either the pump inlet port 130 or the supply port 132.

The hydraulic control system 100 also includes a pressure sensor 150, a controller 160, and an operator input device 170. The pressure sensor 150 is disposed at the head end cylinder port 136, and communicates with the controller 160. The input device 170 also communicates with the controller and allows an operator to control the hydraulic circuit 100. For example, the input device 170 allows the operator to extend, retract, or maintain a position of the hydraulic cylinder 116 connected to a load 180. Alternatively, the input device 170 may represent a source of input commands from, for example, a computer used to automatically control the hydraulic cylinder 116 without an operator.

As shown in FIG. 1, the controller 160 communicates electronically with the input device 170, the metering valves 122, 124, 126, 128, the pressure sensor 150, and the solenoid valve 142 associated with the load-hold check valve 140. The controller 160 may receive information from the input device 170, for example, direction and velocity commands, as well as from the pressure sensor 150. Based on the commands from the input device 170 and the pressure sensor 150, the controller may determine a mode of operation for the hydraulic circuit 110 and determine an appropriate set of outputs 165 to the metering valves 122, 124, 126, 128. In one embodiment, the outputs 165 may represent currents to each of the metering valves 122, 124, 126, 128.

Optionally, the hydraulic circuit may include one or more additional actuating cylinders 190 controlled by the controller and receiving pressurized fluid from the pump 112. These additional actuating cylinders 190 may be subjected to a lighter load than the hydraulic cylinder 116. For example, an actuating cylinder configured to tip a bucket to dump a load would be subjected to a lighter load than an actuating cylinder configured to raise and lower the load. The additional actuating cylinder 190 and its corresponding input device 195 are optional elements of the present invention.

Figure 2:
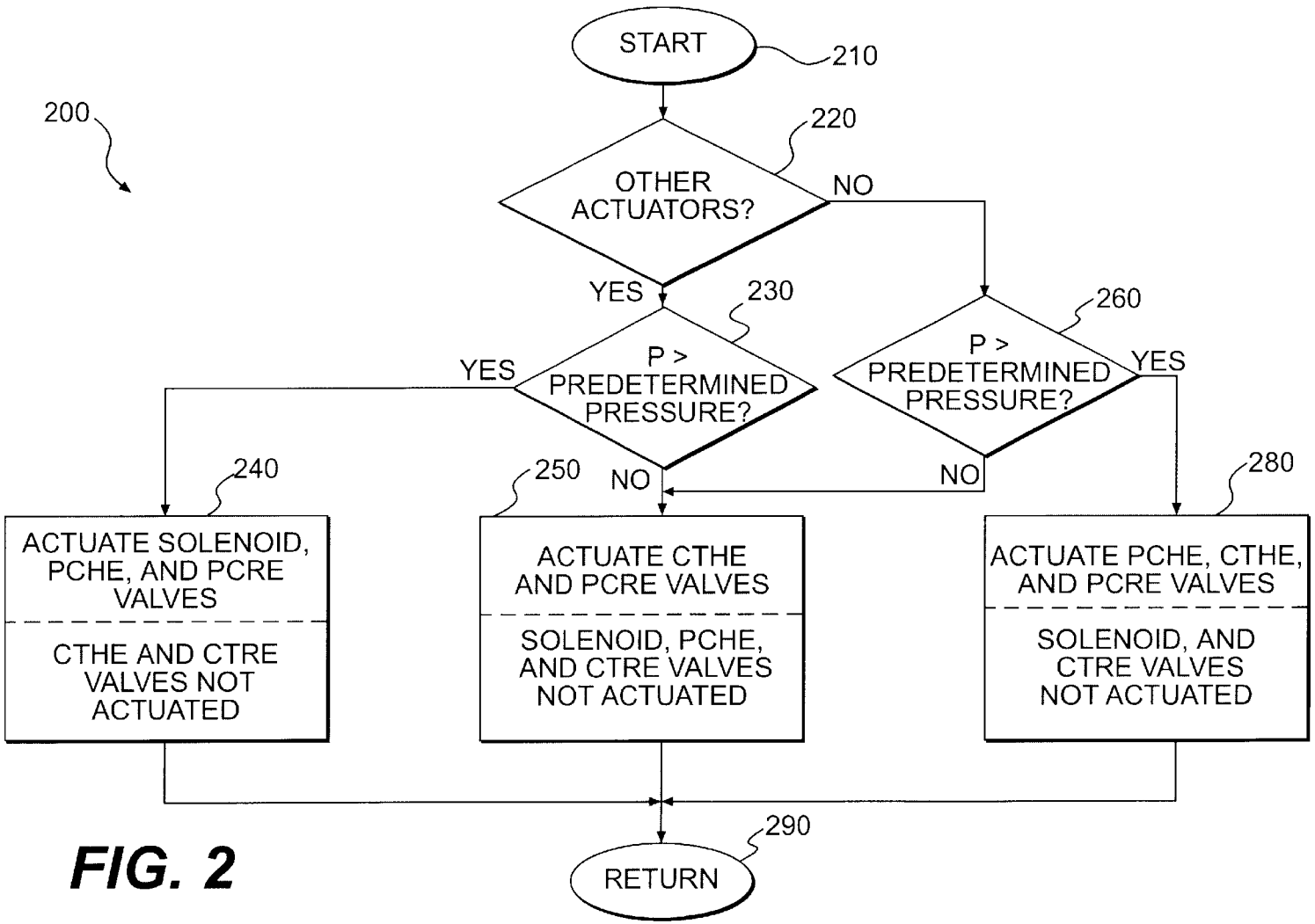
FIG. 2 is a block diagram in accordance with one embodiment of the present invention.

FIG. 2 is an exemplary operation 200 of the controller 160 according to a first exemplary embodiment of the hydraulic circuit 100. Control commences with step 210 when the controller 160 receives a command to start retracting a load 180 attached to a hydraulic cylinder 116. In step 220, the controller 160 determines whether the hydraulic circuit 100 is being used to operate an optional additional actuating cylinder 190. If, in step 220, the controller 160 determines that the circuit 100 is being used to operate an additional actuating cylinder 190, control continues to step 230. If the controller 160 determines that the circuit 100 is not used to operate an additional actuating cylinder 190, control skips to step 260.

In step 230, the controller 160 determines whether the pressure sensor 150 is sensing a pressure greater than a predetermined pressure. In the currently contemplated embodiment, the predetermined pressure is substantially equal to zero or atmospheric pressure. It is recognized that systems having closed, pressurized tanks would have other predetermined pressure levels. If the controller 160 determines that the sensed pressure is greater the predetermined pressure, control continues to step 240. Otherwise, if the sensed pressure is less than or equal to the predetermined pressure, control continues to step 250.

However, if the pressure is greater than predetermined pressure control logic is advanced pursuant to step 240. In step 240, the controller actuates the solenoid valve 142, the PCHE metering valve 124, and the PCRE metering valve 126. Also, in step 240, the controller does not actuate the CTHE metering valve 122 or the CTRE metering valve 128. Control then continues to step 290 which returns control to step 210.

On the other hand, in step 250, the controller actuates the CTHE metering valve 122 and the PCRE metering valve 126. Meanwhile, the solenoid valve 142, the CTRE metering valve 128, and the PCHE metering valve 124 are not actuated. Control then continues to step 290 which returns control to step 210.

In step 260, the controller 160 determines whether the pressure sensor 150 is sensing a pressure greater than the predetermined pressure. As discussed above, the predetermined pressure of the described embodiment is substantially zero. If the controller 160 determines that the sensed pressure is greater than the predetermined pressure, control continues to step 280. Otherwise, if the sensed pressure is less than or equal to the predetermined pressure, control continues to step 250 and operation proceeds as described above.

On the other hand, in step 280, the controller actuates the PCHE metering valve 124, the CTHE metering valve 122, and the PCRE metering valve 126. Meanwhile, the solenoid valve 142 and the CTRE metering valve 128 are not actuated. Control then continues to step 290 which returns control to step 210.

Industrial Applicability

In use, the metering valves 122, 128 control cylinder-to-tank fluid flow while the metering valves 124, 126 control pump-to-cylinder fluid flow. Conventional extension and retraction of the hydraulic cylinder 116 may be respectively achieved by, for example, simultaneous, operator-controlled actuation of the metering valves 124, 128 (extension), and metering valves 122, 126 (retraction).

Numerous less conventional operating modes can be achieved by actuation of a single metering valve or actuation of various combinations of two or more metering valves. However, an understanding of the primary features of the present invention can be achieved by describing the general operation of the hydraulic circuit 100 shown in FIG. 1 without the optional additional actuating cylinder 190. Whenever the condition, i.e., actuated or not actuated, of a metering valve is not specifically described during circuit operation, the metering is not actuated.

Referring to FIG. 1, when the controller 160 receives a command to extend the load 180 of the hydraulic cylinder 116, the PCHE metering valve 124 and the CTRE metering valve 128 are actuated, but the solenoid valve 142 is not actuated. As a result, the spring chamber 144 communicates with the supply port 132, and the load-hold check valve 140 will open. Thus, pressurized fluid is supplied from the pump 112 to the head end chamber 120 via the PCHE metering valve 124, and pressurized fluid from the rod end chamber 118 is discharged to the tank 114 via the CTRE metering valve 128 as the load 180 is extended.

When the load 180 of the hydraulic cylinder 116 is spaced from the working surface 182 and the controller 160 receives a command to retract/lower the load 180, the pressure sensor 150 senses a pressure greater than the predetermined pressure. Thus, the PCHE metering valve 124, the CTHE metering valve 122, and the PCRE metering valve 126 are actuated, but the solenoid valve 142 is not actuated. Consequently, pressurized fluid is supplied from the pump 112 to the rod end chamber 118 via the PCRE metering valve 126. As the load is lowered, a portion of pressurized fluid from the head end chamber 120 is regenerated to the rod end chamber 118 via the PCHE metering valve 124 and the PCRE metering valve 126. The remaining portion of pressurized fluid from the head end chamber 120 is discharged to tank 114 via the CTHE 122.

As the load 180 of the hydraulic cylinder 116 contacts the surface 182 (i.e., load being lowered), for example, the surface of the ground, the weight of the load 180 is substantially supported by the ground. Therefore, the pressure sensor 150 senses a pressure equal to the predetermined pressure. If the controller 160 receives a command to lower the load 180 beyond the surface 182, the PCRE metering valve 126 and the CTHE metering valve 122 remain actuated, while the PCHE metering valve 124 and the solenoid valve 142 are not actuated. As a result, pressurized fluid is supplied from the pump 112 to the rod end chamber 118 via the PCRE metering valve 126, and pressurized fluid is discharged from the head end chamber 120 to the tank 114 via the CTHE metering valve 122. The circuit 100 continues to operate in this manner until the controller 160 no longer receives a command to lower the load 180.

Referring now to FIG. 1, and more specifically to a hydraulic circuit 100 that includes the optional additional actuating cylinder 190, the circuit 100 extends the load 180 similar to that of the hydraulic circuit without the optional additional actuating cylinder. When the controller receives a command to extend the load of the hydraulic cylinder, the PCHE metering valve 124 and the CTRE metering valve 128 are actuated, but the solenoid valve 142 is not actuated. As a result, the spring chamber 144 communicates with the supply port 132, and the load-hold check valve 140 will open. Thus, pressurized fluid is supplied from the pump 112 to the head end chamber 120 via the PCHE metering valve 124, and pressurized fluid from the rod end chamber 118 is discharged to the tank 114 via the CTRE metering valve 128 as the load 180 is extended.

When the load 180 of the hydraulic cylinder 116 is spaced from the working surface 182 (i.e., load being raised) and the controller 160 receives a command to lower the load 180, the pressure sensor 150 senses a pressure greater than the predetermined pressure. Thus, the PCHE metering valve 124, the PCRE metering valve 126, and the solenoid valve 142 are actuated. Consequently, pressurized fluid is supplied from the pump 112 to the rod end chamber 118 via the PCRE metering valve 126. As the load is lowered, the pressurized fluid from the head end chamber 120 is regenerated to both the rod end chamber 118 via the PCHE metering valve 124 and the PCRE metering valve 126 and to the additional actuating cylinder 190 via the PCHE metering valve 124 and the pump inlet port 130. Contrary to the circuit without the optional additional actuating cylinder, the CTHE metering valve is not actuated in this condition and, therefore, pressurized fluid from the head end chamber 120 is not discharged to the tank 114.

While the solenoid valve 142 is actuated, the spring chamber 144 is connected to the pump inlet port 130. Meanwhile, the pressure of the fluid in supply port 132 acts on the annular surface 148 of the load-hold check valve 140. Since a portion of the fluid flow from the pump 112 is going to the low pressure actuator 190, the pressure in the pump inlet port 130 is less than the pressure in the supply port 132. As a result, the load-hold check valve 140 moves against the force of the spring 146 to an open position.

As the load 180 of the hydraulic cylinder 116 contacts the surface 182, the weight of the load 180 is substantially supported by the ground. Therefore, the pressure sensor 150 senses a pressure equal to the predetermined pressure. If the controller 160 receives a command to lower the load 180 beyond the surface 182, the PCRE metering valve 126 remains actuated and the CTHE metering valve 122 is actuated, while the PCHE metering valve 124 and the solenoid valve 142 are not actuated. As a result, pressurized fluid is supplied from the pump 112 to the rod end chamber 118 via the PCRE metering valve 126, and pressurized fluid is discharged from the head end chamber 120 to the tank 114 via the CTHE metering valve 122. Additionally, the pump 112 supplies pressurized fluid to the optional additional actuating cylinder 190. The circuit 100 continues to operate in this manner until the controller 160 no longer receives a command to lower the load 180.

The controller 160 may include a general purpose or special purpose computer, a programmed microprocessor or microcontroller and peripheral integrated circuit elements, an ASIC or other integrated circuit, a hardware electronic or logic circuit such as a discrete element circuit, a programmable logic device such as a PLD, PLA, FPGA or PAL, or the like. In general, any device on which a finite state machine capable of implementing the flowchart shown in FIG. 2 can be used to implement the controller functions of this invention.

Thus, the present invention provides regeneration capabilities during retraction of a load. The system accomplishes regeneration in a relatively uncomplicated manner and without the need for additional expensive components.

It will be apparent to those skilled in the art that various modifications and variations can be made in the hydraulic control system without departing from the scope or spirit of the invention. Other embodiments of the invention will be apparent to those skilled in the art from consideration of the specification and practice of the invention disclosed herein. It is intended that the specification and examples be considered as exemplary only, with a true scope and spirit of the invention being indicated by the following claims and their equivalents.

What is claimed is:

1. A fluid control system comprising:

a pump;

a tank;

an actuating cylinder including a rod end chamber and a head end chamber;

a valve assembly including a first valve configured to control fluid communication between the rod end chamber and the tank, a second valve configured to control fluid communication between the rod end chamber and the pump, a third valve configured to control fluid communication between the head end chamber and the pump, a fourth valve configured to control fluid communication between the head end chamber and the tank, and a selectively-operable load hold check valve configured to control fluid communication between the pump and the actuating cylinder;

a pressure sensor configured to sense a pressure of fluid at the head end chamber; and a controller in communication with the valve assembly and the pressure sensor, the controller being configured to selectively actuate at least one of the first valve, the second valve, the third valve, the fourth valve, and the load hold check valve based on the sensed pressure at the head end chamber and a mode of operation of the control system.

2. The system of claim 1, further including an input device, the input device configured to input a command to the controller, the command indicating the mode of operation of the control system.

3. The system of claim 2, wherein, when the controller receives a command to retract the actuating cylinder and the sensed pressure at the head end chamber is greater than a predetermined pressure, the controller selectively actuates at least one of the first valve, the second valve, the third valve, the fourth valve, and the load hold check valve to regenerate fluid discharged from the head end chamber to the rod end chamber.

4. The system of claim 2, wherein, when the controller receives a command to retract the actuating cylinder and the sensed pressure at the head end chamber is equal to the predetermined pressure, the controller selectively actuates at least one of the first valve, the second valve, the third valve, the fourth valve, and the load hold check valve to supply fluid to the rod end chamber from the pump and to discharge fluid from the head end chamber to the tank.

5. The system of claim 2, further including:

at least one additional actuating cylinder in fluid communication with the pump, the controller configured to control the at least one additional actuating cylinder;

a solenoid valve associated with the load hold check valve, the load hold check valve having a spring chamber;

a pump inlet port providing communication between the pump and the load hold check valve; and a rod end supply port providing communication between the load hold check valve and the second valve.

6. The system of claim 5, wherein the solenoid valve is configured to selectively provide communication between the spring chamber and one of the pump inlet port and the rod end supply port.

7. The system of claim 6, wherein, when the controller receives a command to retract the actuating cylinder and the sensed pressure at the head end chamber is greater than a predetermined pressure, the controller selectively actuates at least one of the first valve, the second valve, the third valve, the fourth valve, and the solenoid valve to regenerate fluid discharged from the head end chamber to the rod end chamber and to the at least one additional actuating cylinder.

8. The system of claim 7, wherein the controller actuates the solenoid valve to a position providing communication between the spring chamber and the pump inlet port.

9. The system of claim 7 wherein, when the controller receives a command to retract the actuating cylinder and the sensed pressure at the head end chamber is equal to the predetermined pressure, the controller selectively actuates at least one of the first valve, the second valve, the third valve, the fourth valve, and the solenoid valve to supply fluid to the rod end chamber from the pump, to discharge fluid from the head end chamber to the tank, and to supply fluid to the at least one additional actuating cylinder from the pump.

10. The system of claim 9, wherein the controller de-actuates the solenoid valve to a position providing communication between the spring chamber and the rod end supply port.

11. A method for controlling a hydraulic system, comprising:

determining a mode of operation of the hydraulic system;

sensing a pressure of fluid at a head end chamber of an actuating cylinder;

selectively controlling fluid flow from a pump to the head end chamber and to a rod end chamber of the actuating cylinder based on the sensed pressure and the mode of operation of the hydraulic system;

selectively controlling fluid flow from the head end chamber and the rod end chamber to a tank based on the sensed pressure and the mode of operation of the hydraulic system; and selectively operating a load hold check valve to control regeneration of fluid from the actuating cylinder.

12. The method of claim 11, further including inputting the mode of operation with an input device.

13. The method of claim 12, wherein the inputting includes inputting a command to retract the actuating cylinder.

14. The method of claim 13, wherein, when the sensed pressure at the head end chamber is greater than a predetermined pressure, at least one control valve is selectively actuated to regenerate fluid discharged from the head end chamber to the rod end chamber.

15. The method of claim 13, wherein, when the sensed pressure at the head end chamber is equal to the predetermined pressure, at least one control valve is selectively actuated to supply fluid to the rod end chamber from the pump and to discharge fluid from the head end chamber to the tank.

16. The method of claim 13, further including:

selectively controlling fluid flow to at least one additional actuating cylinder in fluid communication with the pump; and selectively controlling fluid flow from the pump to the actuating cylinder with a solenoid valve associated with a load hold check valve, the load hold check valve having a spring chamber.

17. The method of claim 16, further including selectively providing fluid communication between the spring chamber and one of fluid flow from the pump and fluid flow to a rod end control valve.

18. The method of claim 17, wherein, when the sensed pressure at the head end chamber is greater than a predetermined pressure, at least one of a plurality of control valves and the solenoid valve is selectively actuated to regenerate fluid discharged from the head end chamber to the rod end chamber and to the at least one additional actuating cylinder.

19. The method of claim 18, wherein the solenoid valve is selectively actuated to a position providing fluid communication between the spring chamber and fluid flow from the pump.

20. The method of claim 18, wherein, when the sensed pressure at the head end chamber is less than or equal to the predetermined pressure, at least one of a plurality of control valves and the solenoid valve is selectively actuated to supply fluid to the rod end chamber from the pump, to discharge fluid from the head end chamber to the tank, and to supply fluid to the at least one additional actuating cylinder from the pump.

21. The method of claim 20, wherein the solenoid valve is selectively de-actuated to a position providing communication between the spring chamber and fluid flow to a rod end control valve.

* * * * *